US008680479B2

(12) United States Patent
Nishiguchi

(10) Patent No.: US 8,680,479 B2
(45) Date of Patent: Mar. 25, 2014

(54) CHARGED PARTICLE ANALYZER

(75) Inventor: Masaru Nishiguchi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 500 days.

(21) Appl. No.: 12/596,056

(22) PCT Filed: May 9, 2007

(86) PCT No.: PCT/JP2007/000492

§ 371 (c)(1),
(2), (4) Date: Oct. 15, 2009

(87) PCT Pub. No.: WO2008/139506

PCT Pub. Date: Nov. 20, 2008

(65) Prior Publication Data

US 2011/0174968 A1 Jul. 21, 2011

(51) Int. Cl.
*H01J 1/50* (2006.01)

(52) U.S. Cl.
USPC ..... 250/396 R

(58) Field of Classification Search
USPC ..... 250/396 R, 492.3, 281, 282, 287, 291, 250/294, 296, 297
See application file for complete search history.

(56) References Cited

U.S. PATENT DOCUMENTS 3,576,992 A * 5/1971 Moorman et al. ..... 250/287
5,166,518 A * 11/1992 Freedman ..... 250/296
6,300,625 B1 * 10/2001 Ishihara ..... 250/287
6,972,407 B2 * 12/2005 Miller et al. ..... 250/287
7,223,967 B2 * 5/2007 Guevremont et al. ..... 250/288
7,355,168 B2 * 4/2008 Yamaguchi ..... 250/282
7,598,505 B2 * 10/2009 Benveniste ..... 250/492.21

(Continued)

FOREIGN PATENT DOCUMENTS

JP 11-135060 A 5/1999
JP 2004-281350 A 10/2004
JP 2005-347150 A 12/2005
JP 2006-228435 A 8/2006

OTHER PUBLICATIONS

Written Opinion of International Searching Authority dated Jul. 31, 2007, issued in corresponding International application No. PCT/JP2007/000492.

(Continued)

*Primary Examiner* — Robert Kim
*Assistant Examiner* — Jason McCormack
(74) *Attorney, Agent, or Firm* — Sughrue Mion, PLLC

(57) ABSTRACT

An ion entrance opening (15) for introducing ions into an orbit (C) along a sector-shaped electric field entrance optical axis (A) from outside is provided in an outer electrode (11*a*) of a main electrode (11) for producing a sector-shaped electric field for forming the orbit (C). In order to correct the disturbance in the sector-shaped electric field due to the provision the ion entrance opening (15), three electrode correction electrodes (20) are aligned in the direction of the sector-shaped electric field entrance optical axis (A). By appropriately adjusting each of the direct-current voltages applied to the electrode correction electrodes (20), the equipotential lines in the sector-shaped electric field can be substantially the same as in the case where the ion entrance opening (15) is not provided. This configuration can alleviate the shift of the orbit of ions flying along the orbit (C). And, by halting the voltage application to the electrodes (11) and (20), ions can be placed into orbit through the ion entrance opening (15).

9 Claims, 4 Drawing Sheets

(56) References Cited

U.S. PATENT DOCUMENTS

| | | | | |
|---|---|---|---|---|
| 7,932,487 | B2 * | 4/2011 | Kovtoun et al. | 250/282 |
| 2003/0089847 | A1 * | 5/2003 | Guevremont et al. | 250/282 |
| 2005/0045817 | A1 * | 3/2005 | Yamaguchi et al. | 250/287 |
| 2005/0151076 | A1 * | 7/2005 | Yamaguchi et al. | 250/291 |
| 2005/0161597 | A1 * | 7/2005 | Guevremont et al. | 250/294 |
| 2005/0285030 | A1 * | 12/2005 | Farnsworth | 250/287 |
| 2006/0151694 | A1 * | 7/2006 | Guevremont et al. | 250/292 |
| 2006/0192110 | A1 * | 8/2006 | Yamaguchi | 250/288 |
| 2006/0214100 | A1 * | 9/2006 | Verentchikov et al. | 250/287 |
| 2007/0045527 | A1 * | 3/2007 | Ogawa et al. | 250/281 |
| 2007/0284519 | A1 * | 12/2007 | Rockwood et al. | 250/282 |
| 2008/0061227 | A1 * | 3/2008 | Kovtoun | 250/292 |
| 2008/0156978 | A1 * | 7/2008 | Shvartsburg et al. | 250/282 |
| 2008/0210862 | A1 * | 9/2008 | Yamaguchi et al. | 250/291 |
| 2008/0290287 | A1 * | 11/2008 | David | 250/396 R |
| 2009/0014641 | A1 * | 1/2009 | Bateman et al. | 250/282 |
| 2009/0108195 | A1 * | 4/2009 | Guevremont et al. | 250/282 |
| 2009/0179150 | A1 * | 7/2009 | Kovtoun et al. | 250/283 |
| 2009/0314934 | A1 * | 12/2009 | Brown | 250/282 |

OTHER PUBLICATIONS

Japanese Office Action dated Mar. 22, 2011, issued in corresponding Japanese Patent Application No. 2009-513852.

Chinese Office Action dated May 28, 2012, issued in corresponding Chinese Patent Application No. 200780052915.5.

Office Action in corresponding Chinese Patent Application No. 200780052915.5 dated Mar. 4, 2013.

* cited by examiner

CHARGED PARTICLE ANALYZER

TECHNICAL FIELD

The present invention relates to a charged particle analyzer such as a mass spectrometer, electron spectrometer, and energy analyzer, for analyzing charged particles such as an ion or an electron. More specifically, it relates to a charged particle analyzer having a charged particle optical system for making charged particles fly on a curved path.

BACKGROUND ART

A charged particle optical system is a system for focusing, dispersing, spectral-dispersing, deflecting, transporting, or treating otherwise, charged particles such as an ion or an electron by the effect of an electric field or magnetic field. In the following explanation, an ion optical system in which an ion is particularly exampled as a charged particle is described. However, the same is basically true for other charged particles such as an electron.

As an ion optical system for deflecting an ion beam or separating ions in accordance with the mass or energy, a sector-shaped electric field which has a simple configuration and good versatility is often used. Examples of a sector-shaped electric field include a multi-turn time-of-flight mass spectrometer as described in Patent Document 1. In a multi-turn time-of-flight mass spectrometer, a plurality of sector-shaped electric fields are used to form an ion orbit of a closed orbit such as a substantially elliptical orbit, substantially "8" figured orbit, etc. Ions are made to fly along this ion orbit a number of times so that an effectively long flight distance is ensured in order to enhance the mass separation performance on ions.

In such a multi-turn time-of-flight mass spectrometer, an ion source for generating ions and an ion detector for detecting ions may be provided on the orbit in some cases. However, in many cases, ions generated outside the orbit are introduced into the orbit and made to fly around on the orbit for predetermined times, and then the ions are deviated from the orbit and introduced into an ion detector provided outside the orbit to be detected. In order to introduce ions into an orbit and take out ions from the orbit as previously described, it may be required to provide an opening in a sector-shaped electrode for forming a sector-shaped electric field (refer to aforementioned Patent Document 1). In addition to the entrance/exit of ions into or from the orbit, it may be required to make an opening in the sector-shaped electrode to introduce electromagnetic wave such as laser light or X-ray, or a particle beam from the outside in order to monitor the status and mode of the ions flying around on the orbit.

However, in the case where an opening is provided in the sector-shaped electrode as previously described, it is inevitable that the electric field is disturbed near the opening. With the disturbance in the sector-shaped electric field, the orbit of ions becomes nonideal (or not as designed) when they pass through the area, which makes the problems pronounced such as: the mass accuracy is decreased particularly in going around many times or the pass-through ratio of ions is deteriorated and consequently the detection sensitivity is decreased.

Conventionally, in order to alleviate the effect of the disturbance in the electric field due to the provision of an opening in a sector-shaped electrode, a metal mesh, metal wires, or other element is placed at the opening. However, since such a mesh and wire also pose impediment to the passage of ions, they lead to the deterioration of the pass-through ratio of ions and the deterioration of the pass-through efficiency of electromagnetic wave such as laser light or particle beam. Furthermore, since the effect of the disturbance in the electric field remains even with a metal mesh and wire, using such an element is not an appropriate method particularly in the case where an accurate analysis is required.

[Patent Document 1] Japanese Unexamined Patent Application Publication No. H11-135060

DISCLOSURE OF THE INVENTION

Problems to be Solved by the Invention

The present invention has been accomplished to solve the aforementioned problems and the objective thereof is to provide a charged particle analyzer having a charged particle optical system capable of canceling the displacement of the flight orbit of ions (charged particles) by alleviating disturbance in the electric field caused by an opening provided in an electrode for forming a sector-shaped electric field.

Means for Solving the Problems

To solve the previously-described problems, the present invention provides a charged particle analyzer having a charged particle optical system including an electrode in which an outer electrode and an inner electrode are paired for forming a sector-shaped electric field for making a charged particle fly on an arc orbit, and having an opening for allowing a charged particle to pass through or for allowing electromagnetic wave or a particle beam to pass through for monitoring a status of a charged particle, formed in the outer electrode, the charged particle analyzer including:

an electric field correction electrode placed around the opening and fronting a space between the outer electrode and the inner electrode; and a voltage applier for applying a predetermined direct-current voltage to the electric field correction electrode, wherein a disturbance in the sector-shaped electric field due to the opening is corrected by the electric field correction electrode.

The charged particle is an ion or an electron for example, and the charged particle optical system is an ion optical system or an electron optical system.

Effects of the Invention

Though in the charged particle analyzer according to the present invention, the sector-shaped electric field is disturbed by an opening provided in the electrode for forming a sector-shaped electric field for making a charged particle fly on an arc orbit, the direct-current electric field formed by the supplementary provided electric field correction electrode alleviates the disturbance in the sector-shaped electric field. Therefore, in passing the sector-shaped electric field formed by the electrodes, charged particles fly on substantially the same orbit as in the case where no opening is provided, drawing an arc shaped orbit. Consequently, the provision of the opening does not decrease the pass-through ratio of charged particles such as ions, and ensures a high analysis sensitivity. In a mass spectrometer for example, the displacement of ion orbit is alleviated, which prevents the mass accuracy from deteriorating. This is particularly effective in increasing the number of turns to extend the flight distance.

The degree of electric field correcting effect by the electric field correction electrode can be determined in accordance with a required performance. That is, in the case where a high analysis accuracy and analysis sensitivity are required, an electric field correction with accordingly high precision is required. Although the number of electric field correction electrode can be arbitrarily determined, the more the number is, the more flexible the adjustment can be and the more the accuracy of the electric field correction is enhanced. Given such factors, in the charged particle analyzer according to the present invention, a plurality of the electric field correction electrodes may be provided, and they may be aligned along the straight optical path of a charged particle, electromagnetic wave, or a particle beam entering or exiting through the opening.

In this configuration, preferably the voltage applier can independently and respectively apply direct-current voltages to the plurality of electric field correction electrodes.

This enables the correction of the disturbance in the electric field with high accuracy by appropriately adjusting each direct-current voltage applied to the plurality of electric field correction electrodes. In addition, this facilitates the operation for finding an appropriate voltage for such correction.

As an embodiment of the charged particle analyzer according to the present invention, the charged particle may be an ion; the sector-shaped electric field may form an orbit and make an ion fly along the same orbit a number of times; and the opening may be for making an ion enter from an outside into the orbit or for making an ion deviated from the orbit exit to the outside.

This embodiment is applied to a multi-turn time-of-flight mass spectrometer, Fourier transform mass spectrometer, energy analyzer, and other analyzers. In a multi-turn time-of-flight mass spectrometer for example, ions generated in an ion source may be injected into the orbit through an opening provided in an electrode for forming a sector-shaped electric field, and after making the ions fly along the orbit appropriate times, the ions may be ejected from the orbit through the opening provided in the electrode for forming a sector-shaped electric field to be detected by the ion detector. Since the disturbance in the sector-shaped electric field is corrected by the electric field correction electrode, the displacement and disturbance of the orbit of ions in flying on the orbit can be alleviated and ions can be led to the ion detector with a high pass-through ratio. Accordingly, high analysis sensitivity can be achieved. Furthermore, no orbit displacement achieves a high mass resolution.

Moreover, in the aforementioned embodiment, the opening may be formed on the line extending from the entrance/exit straight optical axis entering into the sector-shaped electric field from the end of the paired electrodes for forming a sector-shaped electric field or exiting from the end of the pair electrodes; and an entrance/exit of an ion through the opening or a flight of an ion on an arc orbit in the sector-shaped electric field can be selected in correspondence to a voltage applied to the paired electrodes.

That is, in deviating ions flying on an orbit from the orbit to take them outside for example, if an application of voltage to the electrodes each forming a sector-shaped electric field is halted, ions go straight in the direction which they were going immediately before. Therefore, ions can be ejected outside through an opening formed on the outer electrode of the electrodes. As just described, it is possible to easily change the ions' orbit by the presence or absence of the application of voltage to the electrodes.

EXPLANATION OF NUMERALS

1 . . . Ion Optical System
E1,E2,E3,E4 . . . Toroidal Sector-Shaped Electric Field
11,12,13,14 . . . Main Electrode
11*a*,12*a*,13*a*,14*a* . . . Outer Electrode
11*b*,12*b*,13*b*,14*b* . . . Inner Electrode
15 . . . Ion Entrance Opening
16 . . . Ion Exit Opening
20,21 . . . Electric Field Correction Electrode (FAE)
A . . . Sector-Shaped Electric Field Entrance Optical Axis
B . . . Sector-Shaped Electric Field Exit Optical Axis
C . . . Orbit

BEST MODE FOR CARRYING OUT THE INVENTION

Figure 1:
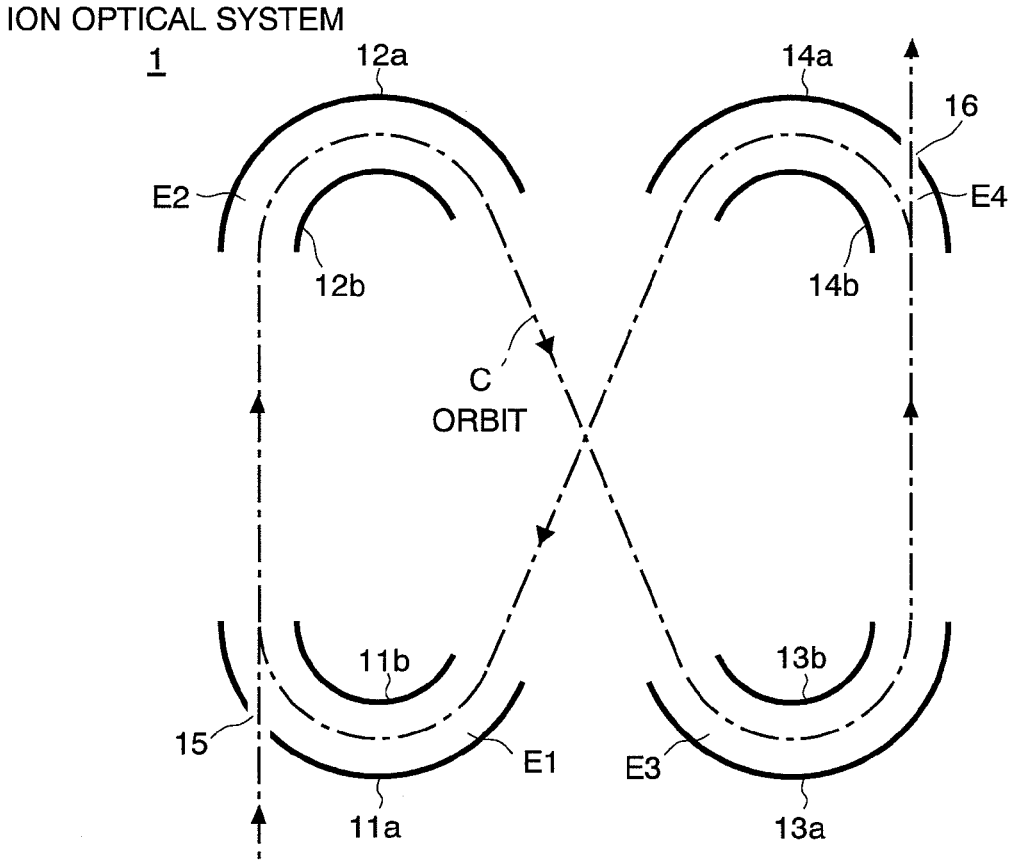
FIG. 1 is a plain view of an ion optical system for forming an orbit on which ions are made to multi-turn in a multi-turn mass spectrometer which is an embodiment of the present invention.

As an embodiment of the charged particle analyzer according to the present invention, a multi-turn mass spectrometer will be explained. FIG. 1 is a plain view of an ion optical system for forming an orbit on which ions are made to multi-turn in this multi-turn mass spectrometer.

In an ion optical system 1, four main electrodes in which an outer electrode and an inner electrode are paired are placed, and a substantially "8" figured orbit C is formed by the effect of electrostatic field formed by a direct-current voltage applied to each of the main electrodes. That is, the first troidal sector-shaped electric field E1 is formed between an outer electrode 11*a* and inner electrode 11*b* of the first main electrode 11, the second troidal sector-shaped electric field E2 between an outer electrode 12*a* and inner electrode 12*b* of the first main electrode 12, the third troidal sector-shaped electric field E3 between an outer electrode 13*a* and inner electrode 13*b* of the first main electrode 13, and the fourth troidal sector-shaped electric field E4 between an outer electrode 14*a* and inner electrode 14*b* of the first main electrode 14. In passing through each of the troidal sector-shaped electric fields E1 through E4, the ion path is significantly curved in an arc shape, and in a free flight space where an electric field does not reach, ions substantially fly straight, which forms an orbit C as illustrated.

While flying along this orbit C, ions are separated in accordance with their mass, i.e. resulting in temporal differences on the orbit C. In the outer electrode 11*a* of the first main electrode 11 for introducing an ion from outside into this orbit C, an ion entrance opening 15 which is large enough for an ion beam to pass through. In order to take out ions from the orbit C, an ion exit opening 16 which is large enough for an ion beam to pass through is formed in the outer electrode 14*a* of the fourth main electrode 14. The ion entrance opening 15 is provided on the line extending from the ion optical axis in the free flight space between the first main electrode 11 and the second main electrode 12. Therefore, in injecting ions into the orbit C through the ion entrance opening 15, the voltage applied to the first main electrode 11 from a power supply unit which is not shown may be canceled, and after the ions' injection is finished, a predetermined voltage may be applied to the first main electrode 11 so that ions fly around along the orbit C. The ion exit opening 16 is provided on the line extending from the ion optical axis in the free flight space between the third main electrode 13 and the fourth main electrode 14. Therefore, in ejecting ions from the orbit C through the ion exit opening 16, the voltage applied to the fourth main electrode 14 from a power supply unit which is not shown may be canceled.

Figure 2:
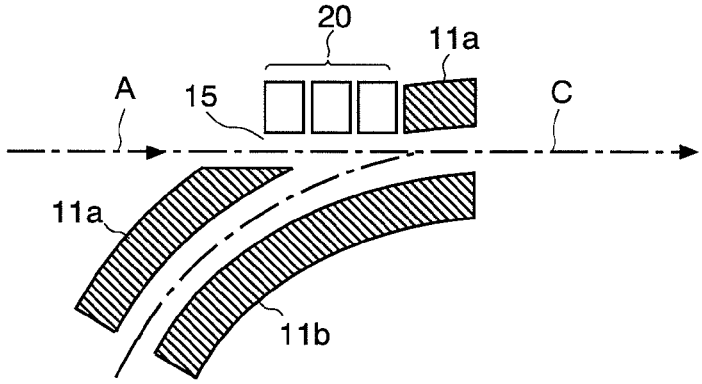
FIG. 2 is a plain view of the vicinity of an ion entrance opening in the ion optical system of the multi-turn mass spectrometer of the present embodiment.
Figure 3:
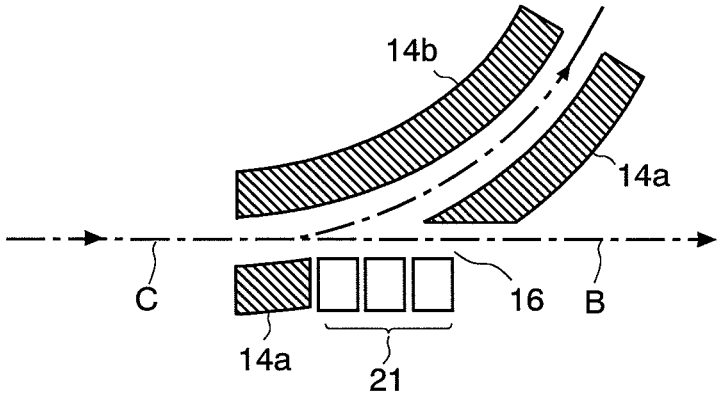
FIG. 3 is a plain view of the vicinity of an ion exit opening in the ion optical system of the multi-turn mass spectrometer of the present embodiment.
Figure 4:
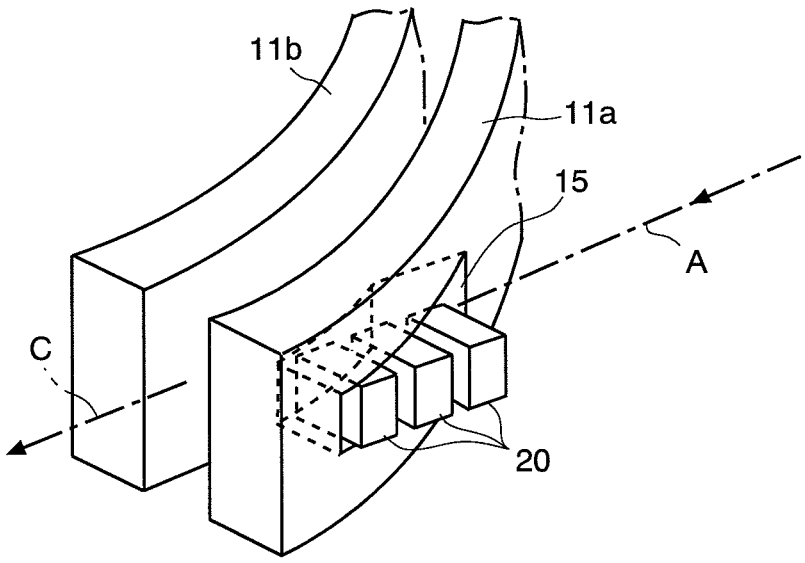
FIG. 4 is a schematic perspective view of the vicinity of an ion entrance opening in the ion optical system of the multi-turn mass spectrometer of the present embodiment.

FIG. 2 is a plain view of the vicinity of the ion entrance opening 15, FIG. 3 is a plain view of the vicinity of the ion exit opening 16, and FIG. 4 is a schematic perspective view of the vicinity of the ion entrance opening 15. Since the ion entrance opening 15 and the ion exit opening 16 are provided in the outer electrodes 11*a* and 14*a*, in applying a predetermined voltage for turning, a part of the troidal sector-shaped electric field E1 and E4 is inevitably disturbed in the vicinity of the openings 15 and 16. Due to this disturbance, ions flaying along the orbit C are deviated from the ideal orbit (normally, central orbit). Hence, in this ion optical system 1, in order to correct the disturbance in the aforementioned electric field, the electric field correction electrodes 20 and 21 are each provided around the ion entrance opening 15 and the ion exit opening 16.

In the configuration of this embodiment, at the ion entrance opening 15, three rectangular-parallelepiped electric field correction electrode 20 are placed outside the beam line (i.e. in such a manner as to replace with a portion of the outer electrode 11*a*) and along the sector-shaped electric field entrance optical axis A. Here, the three electric field correction electrodes are each called FAE1,FAE2, and FAE3, in the order from the side of the orbit C. However, the shape of the electric field correction electrode 20 is not necessarily required to be a rectangular parallelepiped and can be modified to have an appropriate shape according to the situation. In addition, the number of electric field correction electrodes 20 placed is not limited: a necessary and sufficient correction can be performed even with a single electrode depending on the required accuracy of the electric field correction, and the more the number of electrodes becomes, the more flexible the adjustment can be and the accuracy of the electric field correction increases. In the meantime, also at the ion exit opening 16, three electric field correction electrodes 21 are placed along the sector-shaped electric field exit optical axis B and outside the beam line.

Figure 5:
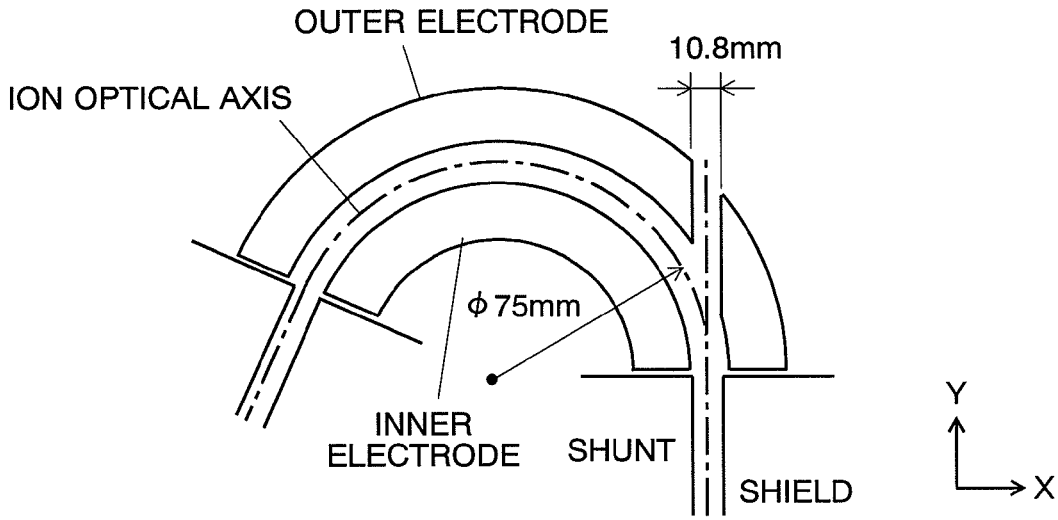
FIG. 5 is a plain view of an orbit computation model in the case where an electric field correction electrode is not used.
Figure 6:
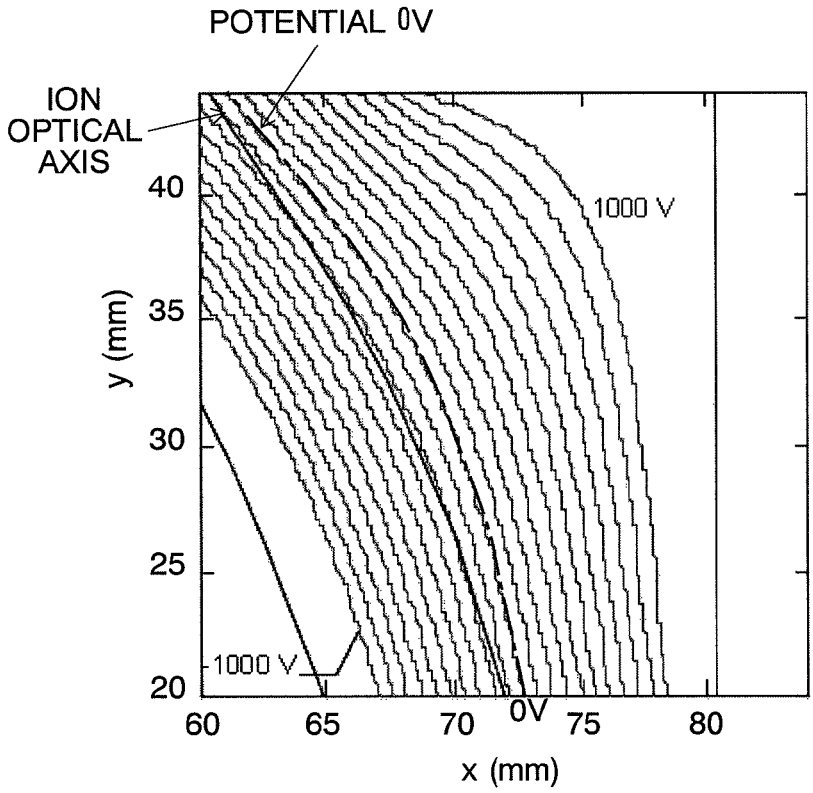
FIG. 6 illustrates a computational result of the equipotential lines around the ion entrance opening (ion exit opening) in the case where an electric field correction electrode is not used.

The effect of the electric field correction in the case where the electric field correction electrodes 20 and 21 as previously described are provided will be described using the result of a simulation computation. FIG. 5 is a plain view of the orbit computation model in the case where an electric field correction electrode is not used (i.e. in a conventional configuration), and FIG. 6 is a diagram illustrating the computational result of the equipotential lines in the vicinity of the ion entrance opening (or ion exit opening) in the configuration of FIG. 5. These equipotential lines are a computational result on the central orbit plane which is the plane including the ion optical axis, and are illustrated in the range of ±1000[V] at 100[V] steps centering on 0[V]. The range was set to be between ±1000[V] in order to show the condition of equipotential lines in an understandable manner and ions turning along the orbit C actually pass in a narrower range closer to the central axis line.

In a sector-shaped electric field, ideally, an equipotential line has an arc shape on the central orbit plane and the electric potential on the ion optical axis must be zero. However, as is understood from FIG. 6, equipotential lines are significantly distorted in such a manner as to bulge outward around the ion entrance opening (or ion exit opening), and furthermore, the electric potential on the ion optical axis is shifted from zero in the direction of the negative polarity. This confirms that an ideal sector-shaped electric field is not formed due to the provision of an ion entrance opening (ion exit opening). Due to the effect of such disturbed electric field, ions are shifted from an ideal turning state while turning, which might lead to the deterioration of the mass accuracy and in some cases ions might disperse along the way.

Figure 7:
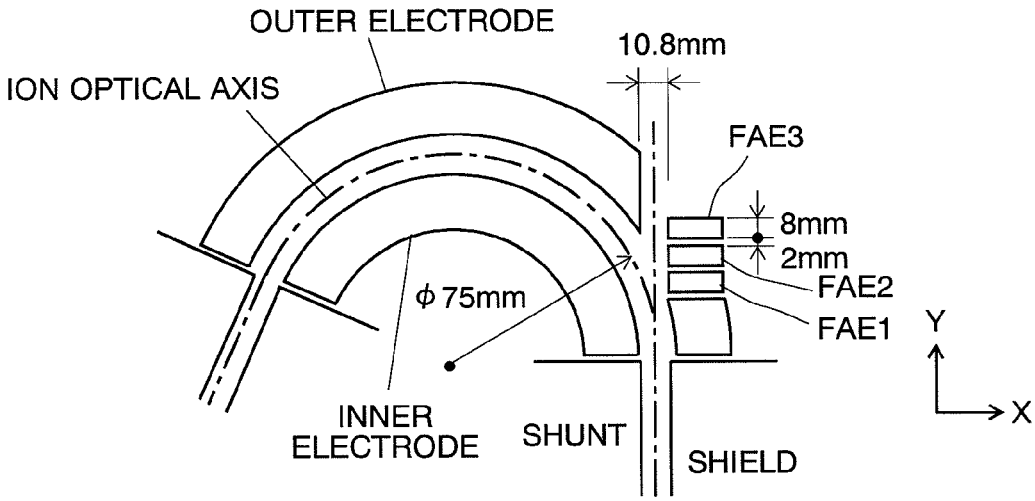
FIG. 7 is a plain view of an orbit computation model in the case where an electric field correction electrode is provided as in the present embodiment.
Figure 8:
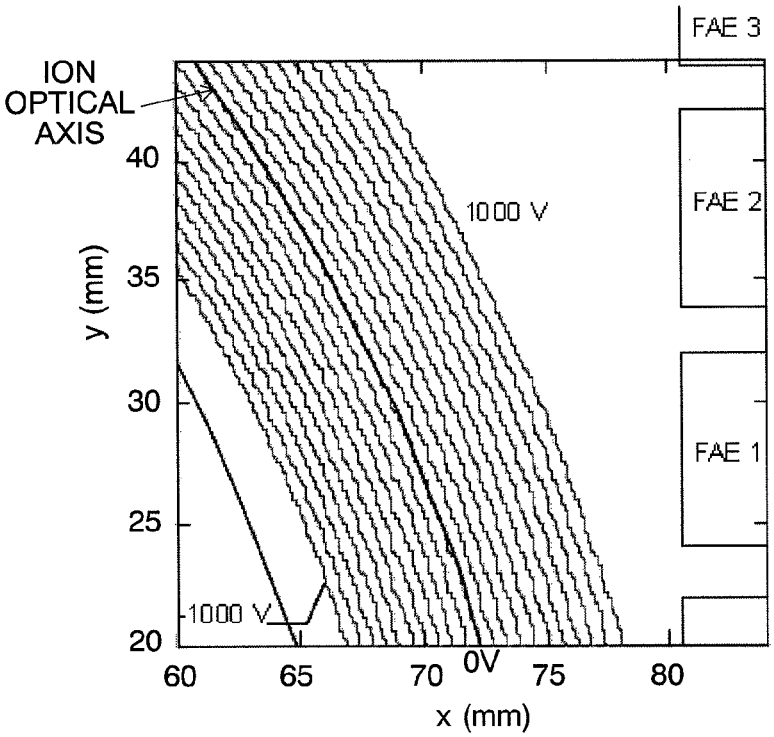
FIG. 8 is a diagram illustrating a computational result of the equipotential lines around the opening in the case where an electric field correction electrode is provided.

FIG. 7 is a plain view of an orbit computation model in the case where an electric field correction electrode is provided as in the present embodiment, and FIG. 8 is a diagram illustrating a computational result of the equipotential lines around the ion entrance opening (or ion exit opening) in that case. In this case, the width of an electric field correction electrode (or the width in the direction of the sector-shaped electric field entrance optical axis A or sector-shaped electric field exit optical axis B) was 8 [mm], and the interval between adjacent electric field correction electrodes was 2 [mm]. The voltage applied to the main electrodes was +1397.68[V] for the outer electrodes and −1397.68[V] for the inner electrodes. The voltage applied to the electric field correction electrodes was +1756[V] for FAE1, +2540[V] for FAE2 and +3313[V] for FAE3. If the voltage applied to the main electrodes is denoted by Vc, the voltages applied to FAE1, FAE2, and FAE3 can be respectively expressed as 1.256 Vc, 1.817 Vc, and 2.370 Vc.

As is clear from FIG. 8, it is confirmed that due to the effect of the electric field formed by the electric field correction electrodes, the equipotential lines have a substantially ideal (i.e. as in the case where no ion entrance opening and exit opening are provided) arc shape, and the electric potential on the ion optical axis is zero. That is, it has been shown that the disturbance in the electric field due to the provision of the ion entrance opening and ion exit opening can be corrected by providing the electric field correction electrodes to a satisfactory degree.

The aforementioned values were those found by trial and error while performing simulations, and therefore the computational result based on these values does not necessarily show the best electric field correction state. However, since the degree of accuracy of actually required electric field correction varies case by case, an appropriate designing in accordance with the required accuracy may be performed as a matter of course.

In the aforementioned embodiment, an explanation was made for the case where an opening for allowing ions to pass through is provided in the main electrode which generates a sector-shaped electric field forming a multi-turn orbit. However, this can be applied not necessarily to a multi-turn orbit but to a variety of configurations in which the course of ions is bent in a curvature shape using a sector-shaped electric field.

In the outer electrode of the electrode for forming a sector-shaped electric field, an opening may be provided for a purpose other than the entrance/exit of ions as previously described. For example, electromagnetic wave such as laser light or X-ray may be introduced from outside along the sector-shaped electric field entrance optical axis A in FIG. 2 or the sector-shaped electric field exit optical axis B in FIG. 3, and the status and mode of flying ions are monitored. Conventionally, at portions where an electrode for forming a sector-shaped electric field poses an impediment, the provision of an opening for introducing electromagnetic wave as previously described was avoided. However, by using an electrode with an opening and an electric field correction electrode as in the aforementioned embodiment, an introduction line of electromagnetic wave (or other particle beams) can be ensured without effecting an ion optical system. Therefore, the development of nonconventional and new application can be expected. Examples of such applications include: a laser-desorbed ion source, a laser post ionization apparatus for sputtering, ion trap for a photodissociation method or an electron capture dissociation method, ion cooling using a laser, X-ray photoelectron spectrometer, and other apparatuses.

The invention claimed is:

1. A charged particle analyzer having a charged particle optical system including an electrode in which an outer electrode and an inner electrode are paired for forming a sector-shaped electrostatic field for making a charged particle fly on an arc orbit, and having an opening for allowing a charged particle to pass through or for allowing electromagnetic wave or a particle beam to pass through for monitoring a status of a charged particle, the opening being formed in the outer electrode and positioned on a straight line extending from an optical axis, the charged particle, the electromagnetic wave, or the particle beam entering or exiting from the arc orbit through the opening along the straight line, the charged particle analyzer comprising:

an electric field correction electrode placed around the opening, arranged along the straight line, and fronting a space between the outer electrode and the inner electrode; and a voltage applier for applying a predetermined direct-current voltage to the electric field correction electrode, wherein a disturbance in the sector-shaped electric field due to the opening is corrected by the electric field correction electrode.

2. The charged particle analyzer according to claim 1, wherein a plurality of the electric field correction electrodes are provided which are aligned along a straight optical path of a charged particle, electromagnetic wave, or a particle beam which enter or exit through the opening.

3. The charged particle analyzer according to claim 2, wherein the voltage applier can independently and respectively apply direct-current voltages to the plurality of electric field correction electrodes.

4. The charged particle analyzer according to claim 1, wherein:

the charged particle is an ion;

the sector-shaped electric field forms an orbit and makes an ion fly along the same orbit a number of times; and the opening is for making an ion enter from an outside into the orbit or for making an ion deviated from the orbit exit to the outside.

5. The charged particle analyzer according to claim 4, wherein:

the opening is formed on a line extending from an entrance/exit straight optical axis entering into the sector-shaped electric field from an end of the paired electrodes for forming a sector-shaped electric field or exiting from the end of the paired electrodes; and an entrance/exit of an ion through the opening or a flight of an ion on an arc orbit in the sector-shaped electric field can be selected in correspondence to a voltage applied to the paired electrodes.

6. The charged particle analyzer according to claim 2, wherein:

the charged particle is an ion;

the sector-shaped electric field forms an orbit and makes an ion fly along the same orbit a number of times; and the opening is for making an ion enter from an outside into the orbit or for making an ion deviated from the orbit exit to the outside.

7. The charged particle analyzer according to claim 3, wherein:

the charged particle is an ion;

the sector-shaped electric field forms an orbit and makes an ion fly along the same orbit a number of times; and the opening is for making an ion enter from an outside into the orbit or for making an ion deviated from the orbit exit to the outside.

8. The charged particle analyzer according to claim 6, wherein:

the opening is formed on a line extending from an entrance/exit straight optical axis entering into the sector-shaped electric field from an end of the paired electrodes for forming a sector-shaped electric field or exiting from the end of the paired electrodes; and an entrance/exit of an ion through the opening or a flight of an ion on an arc orbit in the sector-shaped electric field can be selected in correspondence to a voltage applied to the paired electrodes.

9. The charged particle analyzer according to claim 7, wherein:

the opening is formed on a line extending from an entrance/exit straight optical axis entering into the sector-shaped electric field from an end of the paired electrodes for forming a sector-shaped electric field or exiting from the end of the paired electrodes; and an entrance/exit of an ion through the opening or a flight of an ion on an arc orbit in the sector-shaped electric field can be selected in correspondence to a voltage applied to the paired electrodes.

* * * * *